United States Patent [19]

Hammond et al.

[11] 4,073,678

[45] Feb. 14, 1978

[54] HIGH YIELD SEMICHEMICAL WOOD PULPING PROCESS

[75] Inventors: Jack A. Hammond, Covington, Va.; Elias M. Karter, Paducah, Ky.

[73] Assignee: Westvaco Corporation, New York, N.Y.

[21] Appl. No.: 759,455

[22] Filed: Jan. 14, 1977

Related U.S. Application Data

[63] Continuation-in-part of Ser. No. 351,658, April 16, 1973, abandoned, which is a continuation-in-part of Ser. No. 248,868, May 1, 1972, abandoned.

[51] Int. Cl.[2] ..... D21C 3/02; D21C 3/24; D21C 11/04

[52] U.S. Cl. ..... 162/19; 162/33; 162/35; 162/40; 162/62; 162/82; 162/90

[58] Field of Search ..... 162/30 D, 30 R, 33, 162/35, 17, 82, 90, 25, 36, 38, 62, 37, 40, 19

[56] References Cited

U.S. PATENT DOCUMENTS 1,921,539 8/1933 Richter ..... 162/82

FOREIGN PATENT DOCUMENTS 709,600 5/1965 Canada ..... 162/19

OTHER PUBLICATIONS

Christiansen, C. B., Tappi, vol. 43, #6, June 1960, pp. 586–590.

*Primary Examiner*—Richard V. Fisher
*Assistant Examiner*—William F. Smith
*Attorney, Agent, or Firm*—W. Allen Marcontell; Richard L. Schmalz

[57] ABSTRACT

70 To 85% yield semichemical wood pulping may be prepared for mechanical defibration by cooking comminuted hardwood in a continuous digestion vessel with an alkaline cooking solution wherein 50 to 100% as sodium oxide thereof is sodium carbonate. The solution may be formulated from unmodified kraft recovery process green liquor or, if a sulfur free cooking process is desired, the solution may be formulated from soda ash.

8 Claims, 4 Drawing Figures

HIGH YIELD SEMICHEMICAL WOOD PULPING PROCESS

CROSS REFERENCE TO RELATED APPLICATION

This application is a Continuation-In-Part of our earlier co-pending application Ser. No. 351,658 filed Apr. 16, 1973, now abandoned, said co-pending application being a Continuation-In-Part of our application Ser. No. 248,868 filed May 1, 1972 and now abandoned.

BACKGROUND OF THE INVENTION

1. Field of the Invention

The present invention relates to the field of wood pulp and papermaking. More particularly, the present invention relates to the semichamical pulping technique for making unbleached structural paper such as fluting medium for corrugated board.

2. Description of the Prior Art

Wood suitable for the manufacture of paper pulp generally comprises 45 to 55% alpha cellulose and 14–25% hemicellulose fibers bound structurally together with a 15 to 35% quantity of lignin, a tacky, thermoplastic, complex organic compound. Since the continuous formation of a paper web on a moving fourdrinier wire requires that the cellulosic wood fibers be deposited thereon in a 0.05 to 3% aqueous slurry, it is necessary to segregate the individual fibers from the matrix structure of natural occurrence. The process by which such segregation is performed is characterized as the pulping process.

Depending on the desired characteristics of the resulting paper product, wood pulping may be performed by exclusively mechanical means, thermochemical means or by a combination of the two, e.g. semichemical means. Characteristics distinctive of these processes include the degree of lignin removal and yield (weight of oven dry pulp per given weight of oven dry wood). Since mechanical pulping essentially constitutes a shredding process, lignin removal is negligible and yields are in excess of 95%. Chemical pulping, on the other hand, as the objective of removing as much lignin as practicable thereby yielding only 40 to 60% pulp from a wood charge.

The present invention relates to semichemical pulping wherein about half of the soluble lignin is removed for a yield of 70 to 85%.

Semichemical pulps are particularly useful and economical for the production of unbleached, high strength structural paper such as fluting medium for corrugated sheet and containers. In such applications, the residual lignin is functionally useful, due to the thermoplastic properties thereof, as a structural adjunct to strength and rigidity of the product.

Definitively, semichemical pulping is a two-step process that requires a mild single stage chemical treatment of wood chips to weaken the lignin bond on the cellulose fibers followed by a mechanical refining operation to complete the separation.

Historically, semichemical pulps were first made in the 1880's by chemically treating the wood chips with sulphurous acid or bisulphite followed by grinding.

Currently, such pulp is dominately prepared by the neutral or acid sulphite semichemical process wherein the primary chemical agent of delignification is a 120 to 200 grams/liter solution of sodium sulphite and a small quantity (30 to 50 grams/liter) of alkaline compound such as sodium carbonate, bicarbonate or hydroxide. The function served by the alkaline compound is to neutralize the released acids which are highly corrosive to process equipment.

The usual sulphite semichemical "cook" is conducted in batch digesters at 160° to 190° C for 1 to 3 hours with solution (liquor) to wood ratios in the order of 3–4:1 (4 gm liquor: 1 gm oven dry wood). This period may be shortened considerably, however, by a preimpregnation period followed by a 15 to 20 minute transit through a continuous digester at 200° C. Such preimpregnation treatments will be subsequently discussed in greater detail.

From the limited perspective of mere pulp preparation, the sulphite semichemical process is very economical in comparison to the product value. Only the barest minimum of chemical and mechanical energy is expended with relatively simple capital equipment. From the broader view of waste chemical recovery and the consequent ecological effect of sewering such wastes, the otherwise economically attractive sulphite process becomes more marginal. Chemical pulping processes, specifically the "kraft" or alkaline sodium sulphite-sodium hydroxide process, have, by virtue of greater lignin removal, sufficient heat value in combustible organics to support an incineration process of cooking chemical recovery. To recover used cooking chemicals from the sulphite process in a similar manner requires the addition of purchased fuels.

In recent years, it has been discovered that by operating a sulphite pulping operation in conjunction with a kraft operation of 3 to 4 times greater production, expended chemical from both processes may be recovered from a common or "cross" recovery plant. This solution is not won without difficulty, however, due to the cyclic accumulation of sodium ion in the kraft system. Eventually, the system must be purged which means the sewering of a considerable quantity of expensive chemicals and the attendant ecological shock.

Next in the evolution of semichemical pulping came the technique of directly sulfiting green liquor from a kraft-semichemical cross-recovery plant. As in the usual kraft recovery process, black liquor, the collodial, fluidized substance drained from a finished "cook" of wood pulp, is evaporatively concentrated to approximately 60% solids and the combustible organics thereof ignited in an incinerator to generate heat for the foregoing evaporation step. The residue of combustion predominately comprises sodium carbonate and sodium sulfide. When solublized, this residue, or smelt, is characterized as green liquor.

To continue the kraft recovery, the green liquor is subsequently causticized with lime and clarified to convert most of the sodium carbonate to sodium hydroxide.

In the direct sulfitation of green liquor to compound semichemical cooking liquor, a portion of the solublized smelt following incineration is contacted with sulfur dioxide or other reactive sulfur compound to dissociate some of the sodium from the carbonate and generate sodium sulfite: a compound generally considered essential to the semichemical pulping process.

Although the direct sulfitation of green liquor solves the problem of accumulated sodium ion in an otherwise closed system, it substitutes in lieu thereof a sulfur accumulation problem. Moreover, during the direct sulfitation step of the process, a complex interaction between the existing sodium sulfide and dissociated carbonate occurs to generate sodium thiosulfate and hydrogen sulfide. Thiosulfate is an inhibiting agent to the kraft cooking process and hydrogen sulfide, which escapes to the atmosphere, is an odoriferous, toxic, air pollutant.

In view of such prior art history, what has been desired by the semichemical wood pulping industry is a truly closed recovery system for cooking chemicals and preferably one that may be operated, without regard to relative production rates, in conjunction with a kraft system as a cross-recovery plant. As a further desideratum, in view of recently imposed air and stream polluting mill effluent regulations, is a semichemical pulping process that requires little sulfur as an active pulping chemical. An ideal semichemical pulping process would comprise both elements, e.g. a low sulfur cook adaptable to a closed cycle chemical recovery.

The most obvious and direct approach to the problem by a semichemical pulp mill having kraft process recovery facilities available is with the kraft system green liquor. However, a green liquor per se has been considered unsuitable as lacking sufficient active sulfur for wood delignification. For this reason, Richter et al, in their U.S. Pat. No. 2,694,631 contended that "Up to now, no method of manufacturing chemical wood pulp is known in which the green liquor can be used as a cooking liquor for the wood, this being the sole cooking liquor." Unfortunately, Richter et al did not unequivocally succeed, either, since their green liquor cooking process specified a 4 to 10 hours, 100°–110° C, 150–200 psi immersed pretreatment of the chips in an aqueous solution of 12–30% sulfur dioxide. The Richter et al. product objective, however, was a 33% yield alpha cellulose pulp, a product having substantially different properties and uses from those of 70% or greater yield semichemical pulp. Since semichemical cooking times are less than 3 hours in batch digesters, and in continuous digesters, less than 60 minutes and often as short as 5 minutes, the Richter et al disclosure is of little significance to the semichemical industry. Moreover, the sulfur dioxide pretreatment is prohibitive, ecologically if not economically.

Another investigator, Steinar Vardheim, disclosed in the 1967, Vol. 9 issue of Paper ach Trā, a more practical semichemical green liquor cooking process whereby birch chips were cooked, following a 13 minute, 80° C preimpregnation period, in the vapor phase at 150° C for 5 minutes with a 66 to 150 grams/liter sodium ion concentration (expressed as $Na_2O$) of green liquor having 53–74% sodium carbonate, 24–50% sodium sulfide, and 2–14% sodium hydroxide. Vardheim's green liquor was combined with the chips at such a rate as to effect 7.9 grams of sodium ion (as $Na_2O$) per 100 grams of O.D. wood.

Although the mechanical properties of paper formed by Vardheim's pulp are adequate for the purpose intended, the consequent mill and paper odor is intolerable. Since the odor source is hydrogen sulfide and resultant methyl mercaptans, such emissions in large and continuous quantities are dangerously toxic to humans.

SUMMARY

Accordingly, it is an object of this invention to teach a green liquor semichemical paper pulp cooking process that generates little or no hydrogen sulfide or unusual odors.

Another object of this invention is to teach a green liquor semichemical pulping process that requires no antecedent treatment of processing of the chips prior to the digester charge.

Another object of this invention is to teach a simplified, closed recovery cycle for independent semichemical pulp mills.

Another object of this invention is to teach a green liquor semichemical pulp process that is flexible over a wide range of cooking liquor formulations and concentrations.

Another object of this invention is to teach a green liquor semichemical pulping process that is equally effective with either liquid or vapor phase cooking.

Another object of this invention is to teach a green liquor semichemical pulping process combined with a kraft pulping process and cross-recovery system requiring chemical supplementation only for attritional losses.

These and other objects of our invention are accomplished by the discovery that solublized soda ash or kraft process green liquor having a 50 to 100% sodium carbonate constituency of the total sodium ion compound present therein but having less than about 2.4% of the combined oven dry (O.D.) wood weight as sodium sulfide will weaken the lignin-cellulose structural bond of comminuted hardwood in the 70 to 85% yield range for effective mechanical defibration. Moreover, the magnitude of power required for such effective difibration is little if any greater than that required for conventional, neutral sulfite semichemical (NSSC) processes.

BRIEF DESCRIPTION OF THE DRAWINGS

Relative to the drawings wherein like reference characters denominate like parts throughout the several figures.

DESCRIPTION OF THE PREFERRED EMBODIMENTS

Figure 1:
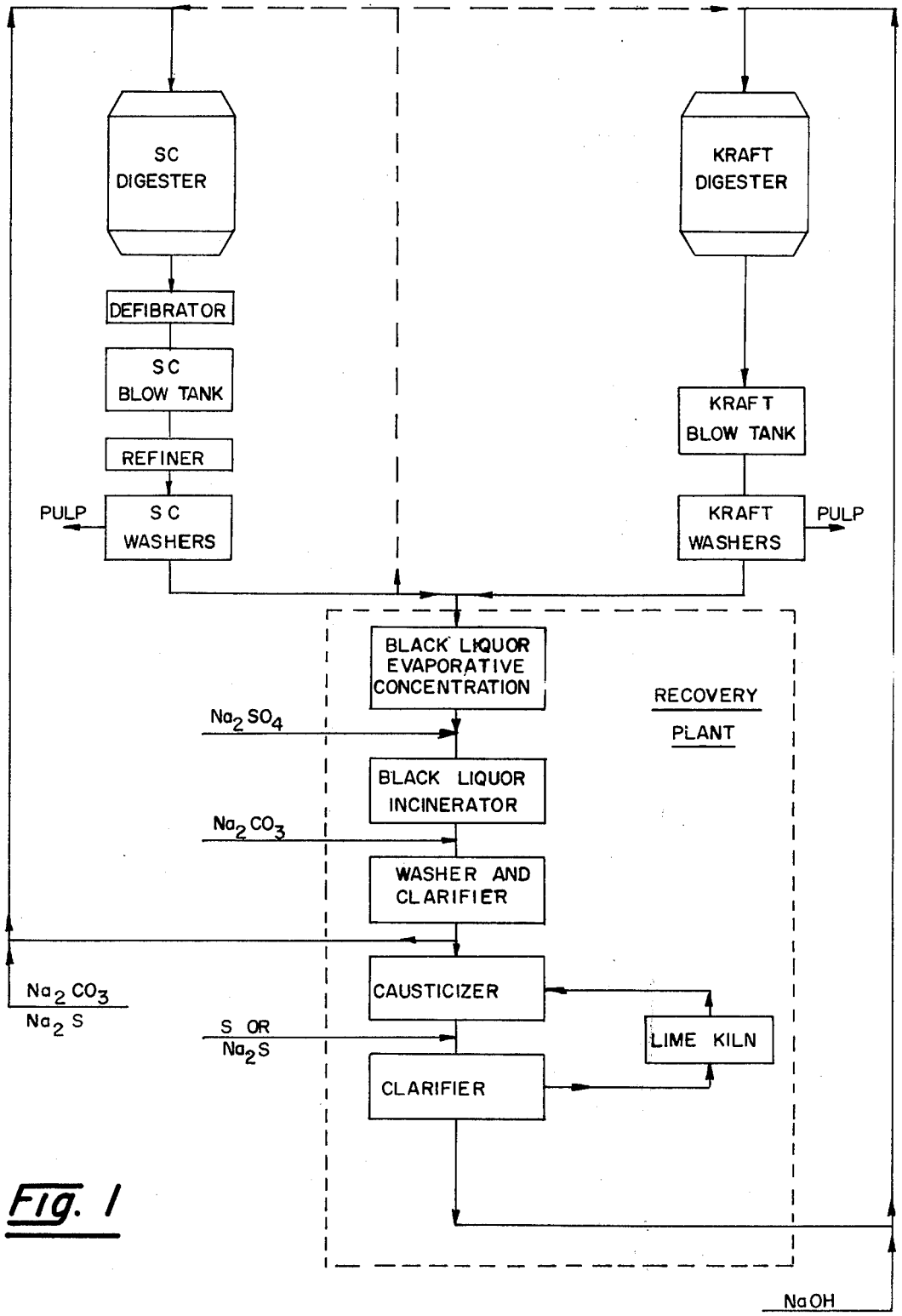
FIG. 1 is a process flow schematic of the present invention shown in cross-recovery combination with a conventional kraft process.

With reference to the FIG. 1 schematic, spent cooking liquor from the respective kraft and semichemical digestion and washing systems of the present invention merge upon entering the liquor recovery plant. Within the evaporative concentration step of the recovery process, enough water from the black liquor fluid system is evaporatively separated therefrom to reduce the system to a fluidized paste of approximately 60% solids. Since the organic components of the solids are combustible, they are ignited in the black liquor incineration section of the recovery furnace to generate heat for the foregoing evaporation step.

Ash or smelt from the incinerator is combined with an aqueous solution to solublize the soluble inorganic compounds for separation from the carbonaceous residue in the washer and clarifier step.

The clarified aqueous solution of inorganic compounds is the substance characterized in the industry as green liquor, the inorganic compounds thereof comprising sodium carbonate, sodium sulfide and a host of other sodium and sulfur bearing compounds. In terms of weight percentages of total sodium ion, measured as sodium oxide, the concentration of sodium carbonate in kraft green liquor may comprise from 50 to 98% of the total sodium ion but more commonly, a concentration of 60 to 98%. Sodium sulfide usually constitutes approximately 15 to 30% of the sodium compound total with the remainder thereof being sodium hydroxide, sodium sulfite, sodium sulfate, sodium thiosulfate and numerous other impurities.

Following the washing and clarification recovery step, that portion of the green liquor production necessary for the semichemical digester cooking charge is taken directly thereto.

The remaining green liquor is subsequently causticized with calcium hydroxide slurried from lime and clarified to convert the dominance of the sodium carbonate to sodium hydroxide.

Effluent from the causticizing sub-cycle is characterized as white liquor and constitutes the primary delignification solution of the kraft digestion process. The constituency of white liquor comprises approximately 80% sodium hydroxide, 15% sodium sulfide and 5% sodium carbonate relative to the total sodium oxide equivalent.

According to the present invention, that portion of the green liquor devoted to semichemical cooking is adjusted for alkaline concentration to the range of 50 to 150 grams/liter as sodium oxide, 50 to 100% thereof being sodium carbonate. Although either water or filtrate from the pulp washers containing dilute black liquor may be used for concentration adjustment, filtrate is preferred as an aid to rapid penetration of the chips by the cooking liquor. This is due to the fact that weak aqeuous solutions of phenol compounds (lignin) have surface tensile strengths approximately half of those for sodium carbonate alone. A reduced surface tension provides reduced resistance from the wood to penetration by the liquor.

Further to our invention, the sodium sulfide ($Na_2S$) content of a cooking liquor charge is believed to be of considerable importance in preventing the generation of hydrogen sulfide ($H_2S$) and derivative methyl mercaptans. The prior art of kraft pulping has placed considerable reliance on the value of $Na_2S$ in the wood delignification process. Pulp and Paper Manufacture, Vol. 1, 2nd Ed., Joint Textbook Comittee of The Paper Industry, McGraw-Hill Book Co., New York, N.Y., 1969, pg. 413. Accordingly, green liquor sulfidities $$(\%\ \text{sulfidity} = \frac{Na_2S}{Na_2S + NaOH + Na_2CO_3} \times 100)$$

for kraft cooking liquor are normally in excess of 25%.

Pursuant to the theories of Erik Hagglund, The Chemistry Of Wood, Academic Press, Inc., New York, N.Y., 1951, 1 gram mole of native lignin irreversibly combines with only 1 gram mole of sulfur in the formation of thiolignin. Considered as a function of the O.D. wood weight and assuming the only surfur in the chemical system available for combination with the wood is derivted from $Na_2S$, Hagglund's molal relation is equivalent to 1.6 $Na_2S$ as a weight percentage of O.D. wood. It should be recognized, however, that Hagglund's observations were based on hydrosulfide pulping of Scandanavian spruce.

Subsequently, Rydholm, Pulping Processes, Interscience Publishers, New York, N.Y., 1965 observed that under kraft pulping conditions for Douglas fir, the wood lignin had a capacity to irreversibly combine with $Na_2S$ up to 2.4% of the O.D. wood weight.

Due to the fact that these theories and findings were developed in conjunction with hydrosulfide and kraft pulping studies, respectively, they have heretofore been considered neither of interest or relevant to semichemical pulp production. Sodium sulfite ($Na_2SO_3$) is the primary delignification agent of the commercially predominate NSSC process and the presence of $Na_2S$ therein is a mere incidence of makeup economicls and/or green liquor sulfitation.

Although it is difficult to relate the green liquor/soda ash semichemical pulping process disclosed herein to either hydrosulfide or kraft processes, logically, there would seem to be greater parallel with the Hagglund hydrosulfide theory. On the other hand, probably due to differences in lignin percentages of O.D. wood weight in various species, an uncontrolled mill variable, and other, yet unidentified factors, experience with out invention seems to focus on the kraft theory of 2.4 $Na_2S$ as a maximum, irreversibly combined, percentage of O.D. wood weight.

An operative consequence of the foregoing findings in our thermochemical system for weakening and dissolving lignin with predominately $Na_2CO_3$ is that a range of only 1.6 to 2.4 grams of $Na_2S$ per 100 grams of O.D. wood weight, depending on species and other factors, is maximally available for direct, irreversible, sulfidation with lignin and any excess is available for other reactions formative of $H_2S$ and methyl mercaptans.

As a point of observation concerning our experience with the foregoing as applied to the following cooks, made with less than 2.4 grams of $Na_2S$ per 100 grams of O.D. wood, was that the presence of $H_2S$ was nil.

Comparatively, it may be found from an analysis of the otherwise similar semichemical pulping technique disclosed by Vardheim that the foregoing relation of $Na_2S$ to O.D. wood was exceeded. Vardheim expressly discussed an unpleasant sulfide odor as a negative incident of his experiments.

Accordingly, if $Na_2S$ is to be found in the cooking liquor makeup, concentrations or application rates should be adjusted to keep the weight quantity of $Na_2S$ from exceeding about 2.4% of the O.D. wood weight if odorous and toxic emissions are to be avoided.

The above described cooking liquor is applied directly to comminuted hardwood, usually having 40 to 60% moisture content, (predominately oak, gum and maple) in the form of chips, shavings or sawdust at a weight ratio wherein the total of titratable sodium compounds expressed as sodium oxide is about 5 to 8% of O.D. wood for cooking in a continuous digestion vessel under vapor phase conditions. The liquor to wood ratio in grams of liquor per gram of O.D. wood is about 2.5:1. No presteaming or preimpregnation of the wood has been found necessary thereby requiring only simple, direct charging of the cooking vessel with wood and green liquor. Digester retention time is between 7 and 8 minutes at 175° C to 185° C.

For continuous liquid phase digestion at the same liquor concentration, the $Na_2O$ application rate may be reduced to the range of 4 to 7% of O.D. wood weight but retention times increased to 14 or 15 minutes at 171° to 177° C.

If cooking is to occur in a continuous digestion vessel under both, liquid and vapor phase conditions, the $Na_2O$ application rate may be from 5 to 8% of O.D. wood but with a retention time of 14 to 15 minutes at 171° to 174° C.

Depending on the particular combination of liquor concentration, application rate, relative presence of $Na_2CO_3$ and $Na_2S$, wood furnish and mechanical equipment to be used, these conditions may be varied within the ranges of 50–150 grams $Na_2O$ per liter of liquor, 50–100% of the $Na_2O$ being in the form of $Na_2CO_3$, 4–10% $Na_2O$ weight per O.D. wood weight and a grams of liquor to grams of O.D. wood ratio of less than 3:1.

The 50–150 gram $Na_2O$ concentration range does not include water contributions from the wood furnish or steam condensate but the liquor to wood ratio does include such contributions.

Our objectives have been to cook the wood as rapidly as possible without resort to preimpregnation. Accordingly, the lower time limit is determined by the mechanical capacity of presently available equipment which is in the order of 5 minutes. The converse is also true since the minimum chip transit time in some continuous digestion equipment may be as long as 1 hour; especially in the case of equipment having integrated preimpregnation and cooking zones. In the case of batch digestion equipment, a cooking time as long as 2.5 hours may be used. Obviously, if longer cooking times are to be used, mild application of chemical and heat are appropriate.

Further to cooking time, the ranges of 5–60 minutes for continuous equipment and up to 2.5 hours for batch equipment are considered as total time interims between combination of the liquor with the wood to defibration. Since we find no need of preimpregnation as a separately controlled process step, we see no need of distinguishing same in the total time interim. The cook is merely brought to control temperature as quickly as possible.

Although cooking interims greater than those outlined above are certainly possible within the purview of our invention, for the purpose of semichemical pulp production, however, longer cooking times should be carefully considered. Excessively long cooks permit an unnecessary protraction of hydrolysis reactions with the hemicellulose constituents of the wood. Loss of hemicellulose not only weakens the pulp but lowers the yield. Moreover, acids formed from such reactions may lower the liquor pH sufficiently to corrosively damage mild steel equipment. Black liquor pH quantities in the order of 8–10 are to be expected from 70–85% yield cooks.

An appropriate cooking temperature should be in the order of 170–185 C.

The extent of present experience has been with hardwood of the oak, gum and maple species as in conventional practice with semichemical pulping systems. However, the present invention is also expected to be effective with coniferous wood species to the same degree as are other semichemical systems.

Following discharge from the digester vessel, the mixture of cooked wood and expended, black liquor is conducted under pressure into a conventional mechanical defibrator which renders the wood to pulp. Thereafter, the pulp is explosively depressurized into a blow tank with a sudden, 60 to 70 psi, pressure reduction.

After the blow tank, the pulp is further worked mechanically by refiner apparatus, either disc or cone type, before washing over conventional rotary drums.

Figure 2:
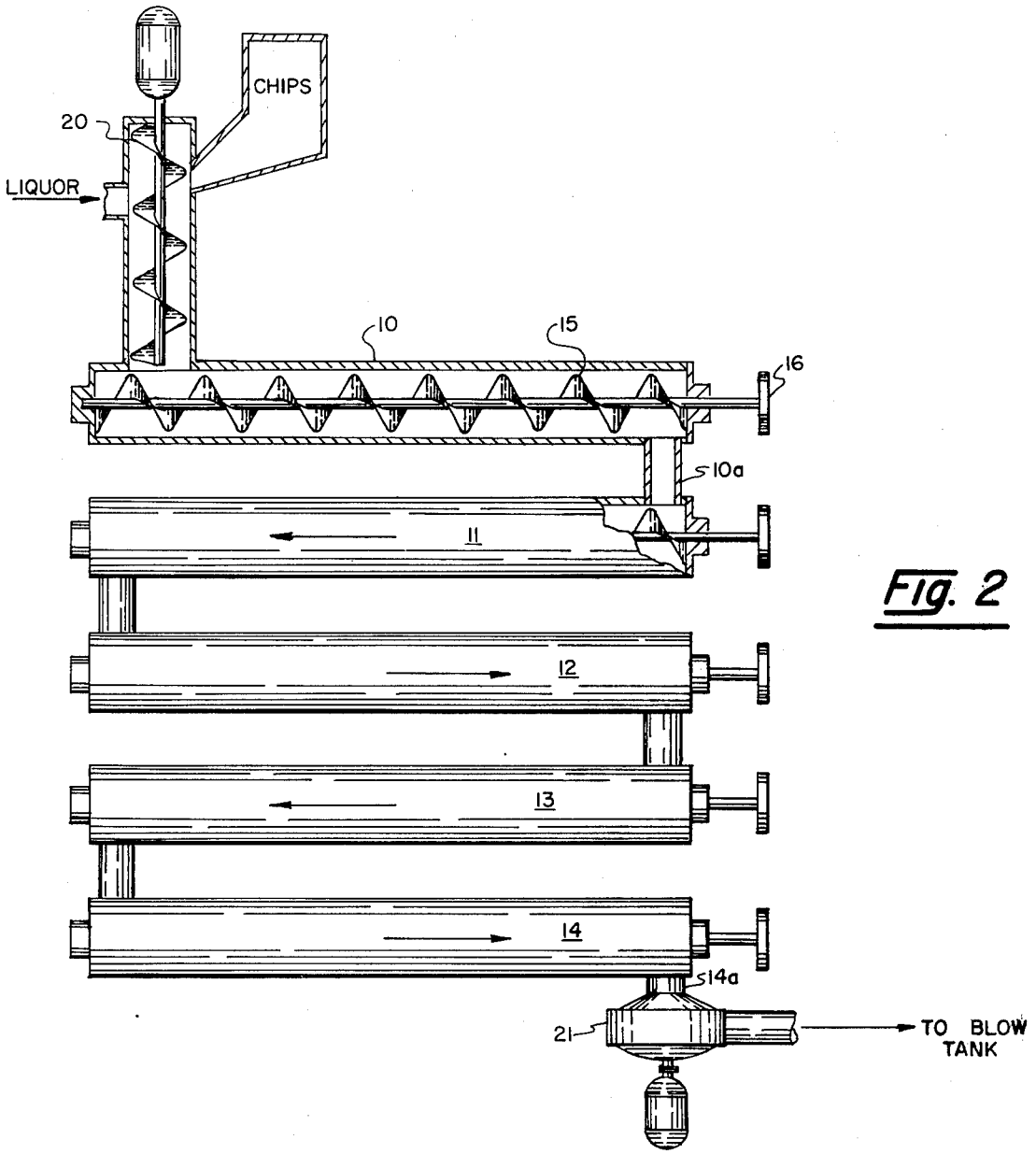
FIG. 2 is a schematic representation of a prior art vertical tube continuous digester useful to the present invention.
Figure 3:
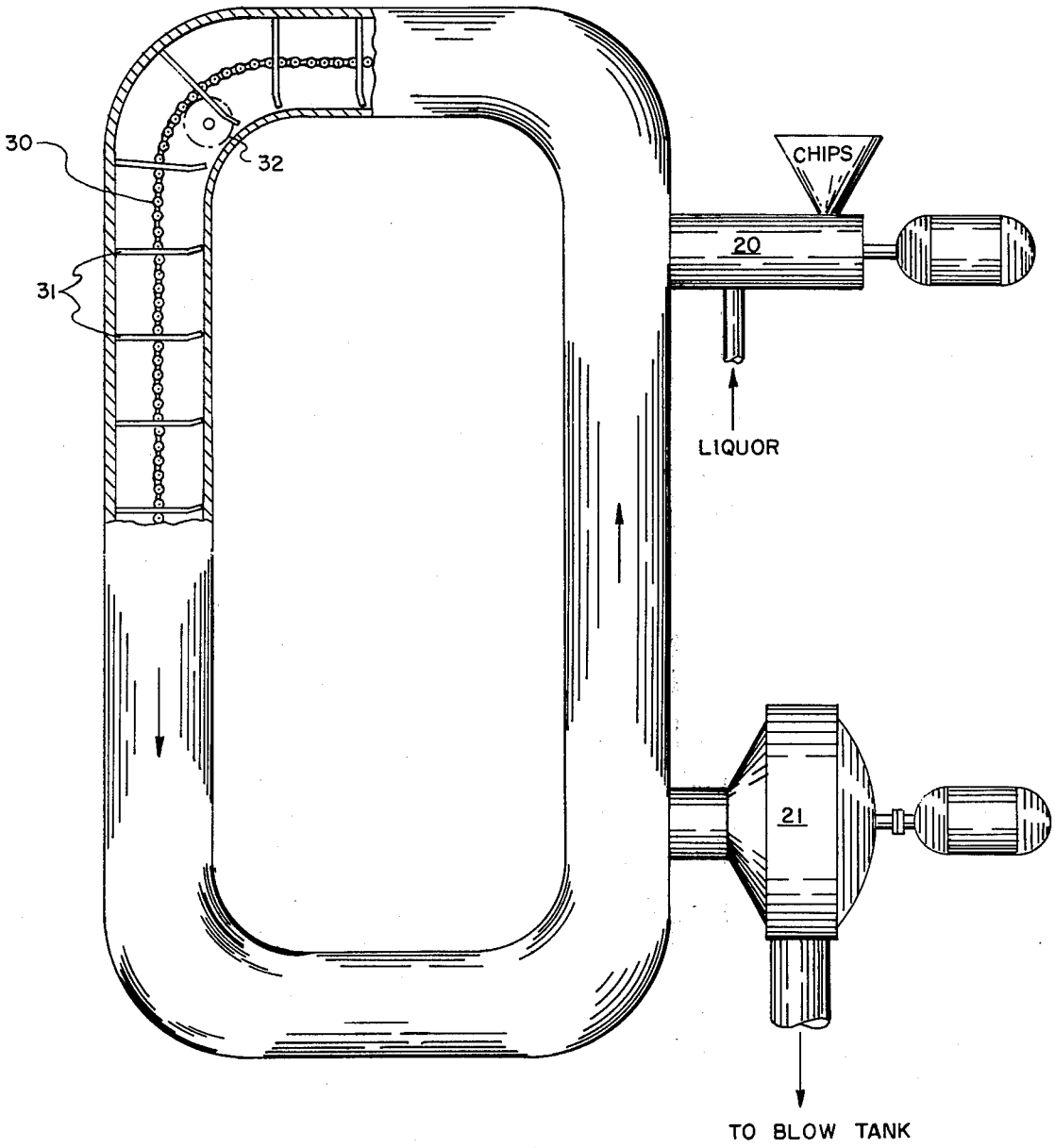
FIG. 3 is a schematic representation of a prior art modified inclined tube digester useful to the present invention.

Continuous digesters of the type described herein are represented by FIGS. 2 and 3. The FIG. 2 continuous digester is characterized as the multiple tube type wherein chips and cooking liquor are continuously charged to the pressurized interior of the first tube 10 by means of a pressure sealing plug screw 20. Transport screw 15, driven by an external power train 16, rotates axially to advance the chip and liquor charge to the tube 10 exist **10*a* which constitutes the entrance for the next tube 11. This process continues through tubes 12, 13 and 14, the exit 14*a* of which leads to a defibrator 21. Heat is supplied to the tubes 10 through 14** by steam lines not shown. Cooking conditions may be individually regulated for each tube thereby allowing liquid phase or vapor phase as desired. Accordingly, the first three tubes may provide vapor phase cooking whereas the liquid phase may prevail in the later two.

The continuous digester represented by FIG. 3 is an oval form of the inclined tube digester wherein mechanical transport of the chip charge is provided by means of traveling bulkheads 31 mounted on a sprocket 32 driven link-chain 30. As in the vertical tube digester of FIG. 2, continuous chip feeding may be provided by a plug screw 20 with discharge into a pressurized defibrator 21. Cooking conditions may be regulated within the inclined tube digester as to fluid phase by permitting some portion of the lower segment thereof to accumulate a liquid head therein, the higher portions of the digester being held in the vapor phase.

Although equipment such as represented by FIGS. 2 and 3 has been used in the actual reduction to practice of our invention, there is no reason to believe that the invention could not also be practiced in other equipment of the single vessel, vertical flow type, either upflow or downflow.

Since the aforedescribed semichemical cooking and recovery cycle is compatible in every phase thereof with a cooperative kraft cycle, it is only necessary to supplement the flow cycle for attritional losses. In this, considerable latitude is allowed to take advantage of current economics and market conditions. For example, supplemental sodium may be introduced to the system at any one of the several points shown in FIG. 1. Waste green liquor from other kraft mills may be added directly to the semichemical green cooking liquor flow stream or to the combined flow stream following the incinerator. Sodium hydroxide in the form of lye or caustic soda may be added directly to the kraft white liquor. Sodium sulfate in the form of natural salt cake may be added to the cross-recovery stream before the incinerator. Refinery waste comprising large concentrations of sodium sulfite may be added to the kraft portion of the cycle between the causticizer and clarifier or directly to the semichemical green cooking liquor flow stream.

Although sulfur or sulfur compounds are unnecessary to the semichemical cook of the present invention as indicated by experience and the absence thereof from one of the following examples, the presence of sulfur compounds within the aforedescribed limits is not deleterious to the semichemical cook and is necessary to the kraft process. Therefore, sufficient elemental sulfur necessary for the kraft cook may be added between the causticizer and clarifier.

In terms of pulp properties from the aforedescribed green liquor semichemical process, mill tests have indicated an equal or higher Concorra Flat Crush strength relative to a neutral sodium sulfite (NSSC) semichemical cook. Machine runnability, as measured by basis weight consistency and paper machine speed, is also higher.

An additional incident of the subject invention has to do with the managerial efficiency of manipulating the semichemical spent liquor as a bulking and pH buffering agent for the kraft cook.

Normally, in semichemical-kraft cross-recovery systems, certain steps are necessary to prevent the precipitation of dissolved lignin when the two streams are combined for recovery. Such steps include adding kraft white liquor or caustic makeup with the semichemical black liquor prior to combined evaporation. Another technique includes separate evaporation for the respective black liquor flow systems.

In the present invention, however, spent liquor from the semichemical cook is low in compounds deleterious to the kraft cook and is useful to the kraft chemical charge as a bulking and pH buffering agent. Accordingly, rather than deplete the available flow stream of white liquor, having a considerable process investment value, to adjust the pH of semichemical spent liquor, the magnitude of said semichemical spent liquor, having little process investment value at this stage of the cycle, may be reduced by utilizing a portion of same with the kraft cooking liquor makeup as indicated in FIG. 1 by the dashed line:

The following examples further illustrate our invention:

EXAMPLE I

A mixture of hardwood chips comprising oak, gum and maple was combined with kraft mill green liquor at the rate wherein the total of titratable sodium compounds expressed as sodium oxide is 5.25% of the weight of oven dry wood. Said green liquor solution had a total alkali concentration of 140 grams/liter, as sodium oxide and comprised 80% sodium carbonate, 12% sodium sulfide, 2% sodium sulfate, and 2% sodium hydroxide. pH of the expended liquor solution direct from the digester was 9.8. Mixing of the chips and cooking solution occurred upon entry to a mechanically advanced continuous digester where retained for 8 minutes at 185° C and 150 psi. Yield from the above was approximately 75%.

EXAMPLE II

A mixture of hardwood chips comprising oak, gum and maple was combined with an aqueous solution of commercial soda ash at the rate of 6.25% of the weight of oven dry wood. Said soda ash solution had a total alkali concentration of 100 grams/liter, as sodium oxide and comprised 98% sodium carbonate with the remainder comprising various compounds of small but indeterminate amounts, possibly including sodium sulfide, sodium sulfate and sodium hydroxide. pH of the expended liquor solution direct from the digester was 9.5. Mixing of the chips and cooking solution occurred upon entry to a mechanically advanced continuous digester where retained for 14 minutes at 174° C and 125 psi. Yield from the above was approximately 78%.

EXAMPLE III

A mixture of hardwood chips comprising oak, gum and maple was combined with kraft mill green liquor at the rate of 6.85% of the weight of oven dry wood. Said green liquor solution had a total alkali concentration of 70 grams/liter, as sodium oxide and comprised 85% sodium carbonate, 10% sodium sulfate, and 1% sodium hydroxide. pH of the expended liquro solution direct from the digester was 9.4. Mixing of the chips and cooking solution occurred upon entry to a mechanically advanced continuous digester where retained for 8 minutes at 185° C and 150 psi. Yield from the above was approximately 76%.

EXAMPLE IV

A mixture of hardwood chips comprising oak, gum and maple was combined with kraft mill green liquor at the rate of 6.55% of the weight of oven dry wood. Said green liquor solution had a total alkali concentration of 100 grams/liter, as sodium oxide, and comprised 80% sodium carbonate, 15% sodium sulfide, 2% sodium sulfate, and 1% sodium hydroxide. pH of the expended liquor solution direct from the digester was 9.4. Mixing of the chips and cooking solution occurred upon entry to a mechanically advanced continuous digester where retained for 8 minutes at 183° C and 140 psi. Yield from the above was approximately 77%.

The foregoing examples were performed on the mill scale with the pulp thereform combined for washing and refining. Consequently, paper web and sheet characteristics cannot be given respective to each example. On a continuous production basis however, pulp from one or more of the above examples has been further combined, as is normal practice for production of fluting medium, with long fiber pulp (box clippings, unbleached pine pulp, etc.) as furnish to a conventional fourdrinier machine for the development of a 0.009 inch caliper web of acceptable quality corrugated fluting medium having a Concorra Flat Crush strength in the range of 40–45 psi. Machine speed and web integrity is equal or better than when operated with NSSC pulp although the web color is distinctively dark.

As previously mentioned in the Description of the Prior Art, the high pulp yield characteristics of this and other semichemical pulping techniques normally render independent recovery plants uneconomical. Due to the highly simplified flow stream of the present invention, however, it is possible that an independent recovery plant may be supported thereby notwithstanding the need to purchase supplementary fuels. Such is the process schematic represented by FIG. 4 wherein evaporation and incineration are the only process steps necessary to reconstitute expended cooking liquor. Moreover, in lieu of an incinerator for oxidatively separating the organic black liquor constituents from the inorganics, it is also possible to use a fluid bed reactor type of device.

Figure 4:
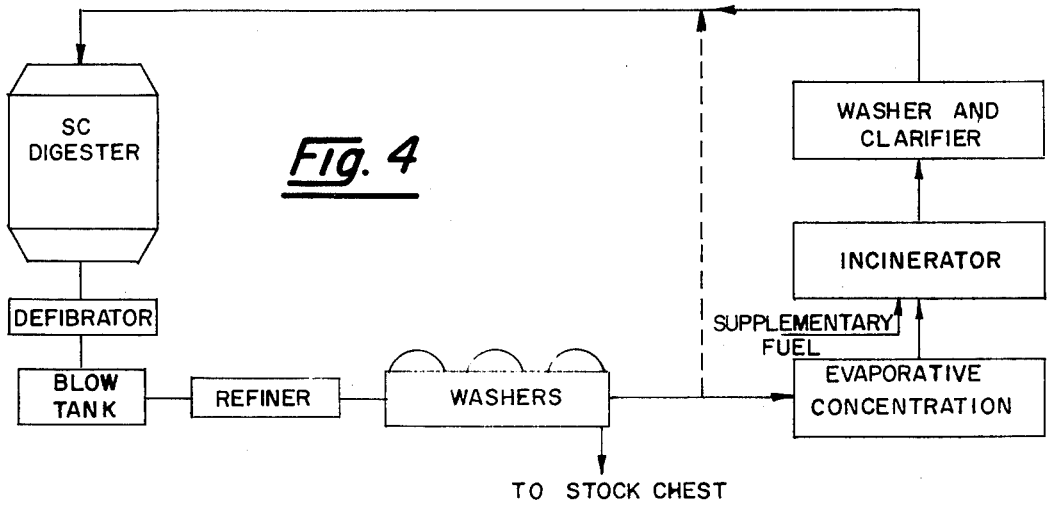
FIG. 4 is a process flow schematic of the present invention supporting an independent recovery plant.

The economic advisability of a FIG. 4 system would have to be developed on an individual installation basis and would depend primarily on the particular yield level at which the digester is operated and the local value of suitable fuels such as coal, natural gas or oil. To complement the economics of a FIG. 4 system, however, is the availability of soda ash as an exclusive liquor makeup chemical. Such a system would require the purchase and management of only one sodium source. Accordingly, recovery would also be for only one chemical, the same being used to replace attritional losses. The feasibility of such a system is the significance of Example II. The cooking liquor described therein was made up entirely of commercial soda ash and water. The mentioned impurities are those normally present in commercial grade soda ash or were introduced to the liquor charge as residual compounds present in the mill piping. The 98% constituency of sodium carbonate for this Example therefore should not be considered as a limitation since none of the compounds present in the remaining 2% are capable of significant contribution to wood delignification in such small concentrations. Accordingly, the 98% constituency of sodium carbonate in this example should, as a matter of practicality, be considered as 100% sodium carbonate.

The commercial impact of a 100% sodium carbonate makeup further underscores the novelty of our invention since, heretofore, sodium carbonate has not been considered as significantly active in the delignification process. Although most, if not all sodium based wood pulping processes include sodium carbonate as a makeup constituent, the objective therefor is based on the view that sodium carbonate is an inexpensive buffering agent for inhibiting the cook from reaching excessively acid pH levels. See E. L. Keller and J. N. McGovern, Neutral Sulphite Semichemical Pulping Aspen, TAPPI Vol. 32, No. 9, September, 1949, page 400. In other words, the prior art view of sodium carbonate in rapid, semichemical pulping has been one of tolerance: the compound is not particularly disruptive of the cooking chemistry and serves a positive function by protecting the pulping equipment.

We have discovered that sodium carbonate, when used as described and as an exclusive makeup chemical, constitutes a wood delignification agent having effectiveness equal or greater than that of a NSSC charge. In terms of current comparative economics, a soda ash liquor charge may be purchased for substantially less than the cost of an NSSC liquor charge.

Laboratory examination of these and other types of pure soda ash cooks indicate the need of approximately 40% more refining energy on the pulp as compared to NSSC pulp to reach a given strength property. However, experience on the commercial mill scale fails to confirm such laboratory data. Although there are some indications that, in the case of a 100% soda ash cook, a slight increase in refining energy may be necessary, the conclusion is uncertain since plus or minus swings of 20% from refining energy norms are commonplace in the commercial NSSC mill. The cause of such fluctuation is generally attributed to seasonal or source distinctions in particular batches of raw wood furnish.

Relative to pulp prepared from our kraft green liquor cook, laboratory data would indicate the need of 20% more power over a comparative NSSC pulp. Considerable experience on the mill scale with both types of pulp, however, refutes such laboratory findings.

Although it would seem, in further light of current economics, that the primary economic thrust of our invention is for high yield pulps not intended for bleaching, it is nevertheless obvious from our findings that suitable bleaching pulps may also be made thereby. By extending the cooking interim beyond those of our examples or other similar changes to the cooking conditions, greater quantities of lignin may be removed from the natural wood matrix.

While the product of our examples was combined with long fiber kraft pulp, it should be understood that the present invention is in no manner limited to such combinations. Depending on the desired paper characteristics, pulp from our process may be used as base stock, exclusively, or in combination with other pulps or fibers just as the pulp from prior art high yield processes.

Having described the preferred embodiments of our invention, we claim:

1. A method of operating a continuous digester having respective charging and discharging ends for the production of semichemical pulp of greater than 70% yield, said method comprising steps of:

A. Formulating a green liquor pulping solution having 50 to 150 grams per liter total alkali concentration measured as sodium oxide wherein at least 50% of said total alkali is derived from sodium carbonate, said solution further including an effective presence of sodium sulfide;

B. Continuously charging said digester at said charging end with said solution and wood chips at a combined flow rate providing 5 to 10 grams of titratable sodium compounds expressed as sodium oxide per 100 grams of O.D. chips but no more than 2.4 grams of sodium sulfide measured as sodium sulfide per 100 grams of O.D. chips;

C. Continuously combining steam with said solution and chip charge flow at a steam flow rate sufficient to provide a liquor-to-wood ratio of up to 2.5:1 and a combined charge temperature of 170° to 185° C;

D. Continuously transporting said combined charge flow between said digester charging and discharging ends over an interim of approximately 5 to 20 minutes; and E. Continuously withdrawing said combined charges from said digester at said discharge end.

2. A method as described by claim 1 wherein the alkalinity of said pulping solution at said discharge end is regulated by the combination of washer filtrate from a pulp washer system at said digester discharging end.

3. A method as described by claim 2 wherein the alkalinity of pulping solution withdrawn from said digester discharge end is approximately 9.4 to 10 pH.

4. A method as described by claim 3 wherein a portion of pulping solution withdrawn from said digester is separated from said chips and residual chemical values therein are recovered in combination with kraft process spent liquor.

5. A method as described by claim 4 wherein a portion of pulping solution withdrawn from said digester is directly combined with kraft process fresh pulping liquor for alkalinity adjustment.

6. A method as described by claim 1 wherein said pulping solution is formulated from green liquor comprising approximately 80% sodium carbonate and 12% sodium sulfide which is concentrated to approximately 140 grams of equivalent sodium oxide per liter and combined with said chips to provide approximately 5.25 grams of equivalent sodium oxide per 100 grams of O.D. chips and retained between said digester charging and discharging ends approximately 8 minutes at approximately 185° C.

7. A method as described by claim 1 wherein said pulping solution is formulated from green liquor comprising approximately 98% sodium carbonate which is concentrated to approximately 100 grams of equivalent sodium oxide per liter and combined with said chips to provide approximately 6.25 grams of equivalent sodium oxide per 100 grams of O.D. chips and retained between said digester charging and discharging ends approximately 14 minutes at 174° C.

8. A method as described by claim 1 wherein said pulping solution is formulated from green liquor comprising approximately 80% sodium carbonate and 15% sodium sulfide which is concentrated to approximately 100 grams of equivalent sodium oxide per liter and combined with chips to provide approximately 6.55 grams of equivalent sodium oxide per 100 grams of O.D. chips and retained between said charging and discharging ends approximately 8 minutes at approximately 183° C.

* * * * *